US005645980A

United States Patent [19]

McGuckin et al.

[11] Patent Number: 5,645,980

[45] Date of Patent: Jul. 8, 1997

[54] ADDENDA FOR AN AQUEOUS PHOTOGRAPHIC RINSING SOLUTION

[75] Inventors: Hugh Gerald McGuckin; John Stuart Badger; Ronald Anthony Gogle, all of Rochester; Paul Joseph Riesenberger, Fairport; Michael William Orem, Rochester, all of N.Y.

[73] Assignee: Eastman Kodak Company, Rochester, N.Y.

[21] Appl. No.: 586,359

[22] Filed: Jan. 16, 1996

Related U.S. Application Data

[60] Continuation of Ser. No. 327,769, Oct. 24, 1994, which is a division of Ser. No. 105,828, Aug. 11, 1993, abandoned.

[51] Int. Cl.[6] ..... G03C 7/407

[52] U.S. Cl. ..... 430/372; 430/428; 430/429; 430/463

[58] Field of Search ..... 430/372, 428, 430/429, 463

[56] References Cited

U.S. PATENT DOCUMENTS

| | | | |
|---|---|---|---|
| 2,618,558 | 11/1952 | Vittum et al. | 430/470 |
| 3,404,004 | 10/1968 | Ake | 430/427 |
| 3,957,658 | 5/1976 | Chiese, Jr. et al. | 252/3 |
| 3,962,150 | 6/1976 | Viola | 252/542 |
| 4,332,886 | 6/1982 | Aoki et al. | 430/551 |
| 4,703,000 | 10/1987 | Hodgins | 430/493 |
| 4,745,047 | 5/1988 | Asami et al. | 430/376 |
| 4,786,583 | 11/1988 | Schwartz | 430/372 |
| 4,849,333 | 7/1989 | Fujita | 430/372 |
| 4,923,782 | 5/1990 | Schwartz | 430/372 |
| 5,104,775 | 4/1992 | Abe et al. | 430/372 |
| 5,110,716 | 5/1992 | Kuse et al. | 430/429 |
| 5,225,320 | 7/1993 | Kuse et al. | 430/463 |
| 5,256,524 | 10/1993 | Yoshimoto et al. | 430/428 |
| 5,270,148 | 12/1993 | Morigaki et al. | 430/463 |
| 5,278,033 | 1/1994 | Hagiwara et al. | 430/463 |
| 5,310,429 | 5/1994 | Chou et al. | 252/173 |
| 5,360,700 | 11/1994 | Kawamura et al. | 430/428 |

FOREIGN PATENT DOCUMENTS

| | | | |
|---|---|---|---|
| 0 342 177 A2 | 11/1989 | European Pat. Off. | C11D 1/83 |
| 0 465 228 | 1/1992 | European Pat. Off. . | |
| 0 217 643 | 1/1993 | European Pat. Off. . | |
| 56-028263 | 3/1981 | Japan . | |
| 57-197540 | 12/1982 | Japan . | |
| 63-244036 | 10/1988 | Japan . | |
| 4025835 | 4/1992 | Japan . | |
| 93/23793 | 11/1993 | WIPO | G03C 7/30 |

OTHER PUBLICATIONS

Research Disclosure No. 19104, Mar. 1990, entitled "Conditioning baths for use in photographic processing", disclosed by M. R. Murray, W. R. Woods, S. R. Levinson, M. W. Orem and S. E. Vincent.

Related Patent Application USSN 07/881916 filed May 21, 1992 of McGuckin et al.

Related Patent Application USSN 08/105828 filed Aug. 11, 1993 of McGuckin et al.

*Primary Examiner*—Hoa Van Le

*Attorney, Agent, or Firm*—Sarah Meeks Roberts; J. Lanny Tucker

[57] ABSTRACT

An aqueous solution for rinsing silver halide photographic elements comprising a nonionic surfactant and an anionic surfactant, wherein the solution has a surface tension of 32 dynes/cm or less and a method for using the rinsing solution.

13 Claims, No Drawings

ADDENDA FOR AN AQUEOUS PHOTOGRAPHIC RINSING SOLUTION

This is a continuation of application Ser. No. 327,769, filed Oct. 24, 1994, which is a divisional of application Ser. No. U.S. 105,828, filed 11 Aug. 1993, abandoned.

FIELD OF THE INVENTION

This invention relates to the field of silver halide photographic processing. It particularly relates to compositions of a rinsing solution which improve the appearance of processed color photographic elements.

BACKGROUND OF THE INVENTION

The processing of silver halide color film generally involves the steps of color evolution, bleaching, fixing, stabilizing or rinsing, and drying. The final rinsing bath is generally used to promote uniform drainage of solution from the photographic elements to avoid the formation of water spots. It may also contain an antimicrobial to prevent the growth of bacteria and fungi both in the rinse itself and on the photographic element. In certain instances the final rinse also serves as the washing solution for the color film.

Nonionic surfactants have been utilized in the industry to promote the drainage characteristics of the final rinsing solution. It has been found, however, that such solutions may cause differential drying problems. For example, after the film is removed from the final rinse, the final rinse solution may be held not only in a thin layer on the surface, but in excess in thin liquid droplets by the film perforations. When the thin droplets of excess liquid burst during or after drying, they may form small puddles of excess solution on the gelatin/image layer. These puddles dry at a slower rate and result in a noticeable mark around the perforation after the film completely dries. Some rinsing solutions containing nonionic surfactants also leave streaks (drying lines) and drip marks on the photographic element.

U.S. Pat. No. 4,778,748 describes a method of processing which utilizes a first stabilizing solution having a surface tension of 20 to 78 dyne/cm and a second stabilizing solution having a surface tension of 8 to 60 dyne/cm. The process is used substantially without a water washing step to promote conservation. There is no mention of drying problems.

U.S. Pat. No. 5,110,716 describes a stabilizing solution containing a polyoxyalkylene type surface active agent which reduces the surface tension of the solution and a triazine type or methylol type compound. The patent states that the polyoxyalkylene compound corrects the running down unevenness and the stains caused by the triazine or methylol type compound.

European Patent Application 465,228 A3 describes a method of processing a silver halide photographic element containing more than 80 mol % chloride which utilizes a stabilizer which has a surface tension of 15 to 60 dynes/cm and which contains a specific type of surface active agent.

European Patent Application 0 217 643 describes a method of processing wherein a silver halide photographic element is developed in a benzyl alcohol-free developer, fixed, and then processed with a stabilizing solution having a surface tension of 8 to 50 dyne/cm and containing no aldehyde compound. The application suggests that any type of surfactant may be used.

None of the above methods solves the continuing need for rinsing solutions with improved uniform drying and drainage to alleviate the problem of water spots and streaking on dried photographic elements, particularly when the rinsing solution is retained by the perforations prior to drying.

SUMMARY OF THE INVENTION

This invention provides an aqueous solution for rinsing silver halide photographic elements comprising a nonionic surfactant and an anionic surfactant, wherein the solution has a surface tension of 32 dynes/cm or less. In one embodiment the nonionic surfactant is a nonionic hydrocarbon polyethoxylated surfactant and the anionic surfactant is a sulfate or sulfonate anionic surfactant. This invention further provides a method of processing a silver halide photographic element utilizing the above rinsing solutions.

The rinsing solutions of this invention reduce or eliminate drying marks, drying streaks and drip marks. This is accomplished by the unexpected combination of reduced surface tension and an anionic/nonionic surfactant mix. Additionally, the solutions do not adversely affect image stability and the components are commercially available and environmentally safe.

DETAILED DESCRIPTION OF THE INVENTION

The rinsing solutions of this invention have a surface tension of 32 dynes/cm or less, more preferably a surface tension of 30 dynes/cm or less, and most preferably a surface tension of 28 dynes/cm or less. The surface tension can be determined by numerous methods known in the art. The measurements described herein were obtained using a Cenco tensiometer (Central Scientific Co., a division of Cenco Instrument Corporation) fitted with a glass plate to contact the liquid. The rinsing solutions do not contain dye stabilizing compounds, that is, compounds that produce a methylene group as the key component for dye stabilization such as formaldehyde or hexamethylentetramine.

The nonionic surfactant may be any such surfactant which is compatible in photographic processing solutions. It is preferred that the nonionic surfactant used reduces the surface tension of the rinsing solution to 42 dyne/cm or less so that, when combined with the anionic surfactant, the lower surface tension of the rinsing solution is more easily achieved. Examples of useful nonionic surfactants include, polyalkyleneoxide modified polydimethylsiloxane (trade name "Silwet L-7607", available from Union Carbide Co.), perfluoroalkyl poly(ethylene oxide) alcohol (trade name "Zonyl FSN", available from Dupont Co.), poly(ethylene oxide)-poly (propylene oxide) and poly(ethylene oxide) di-ol compound (trade name "Pluronic L-44", available from BASF Corp.), and nonylphenoxy poly (hydroxypropylene oxide (8–10)) alcohol (trade name "Surfactant 10G", available from Olin Corporation).

Particularly useful are nonionic polyethoxylated surfactants, particularly hydrocarbon polyethoxylated surfactants and polyethoxylated silicon surfactants. Preferred are nonionic hydrocarbon polyethoxylated surfactants having the general formula $R_1$-$(B)_x$-$(E)_m$-D, wherein $R_1$ is an alkyl group with 8–20 carbons, B is a phenyl group and x is 0 or 1, E is —$(OCH_2CH_2)$—and m is 6–20, and D is —OH or —$OCH_3$. Examples of useful nonionic surfactants described by this general formula include octylphenoxypoly (ethyleneoxide) (9) ethanol (trade name "Triton X-100", available from Union Carbide Co.), octylphenoxypolyethyleneoxide (12) ethanol (trade name "Triton X-102", available from Union Carbide Co.), octylphenoxypolyethyleneoxide (30–40) ethanol (trade name "Triton X-405", available from Union Carbide Co.), alkyl ($C_{12}$–$C_{15}$ mixture)

polyethyleneoxide (7) alcohol (trade name "Neodol 25-7", available from Shell Chemical Co.), and tridecylpolyethyleneoxide (12) alcohol (trade name "Renex 30", available from ICI).

The most preferred nonionic surfactant is octylphenoxypolyethyleneoxide (12) ethanol. Other most preferred nonionic surfactants are polyalkyleneoxide modified poly (dimethylsiloxane) and tridecylpolyethyleneoxide (12) alcohol.

In preferred embodiments the nonionic surfactant is present at a working concentration of approximately 0.05 to 0.6 g/L and more preferably at a working concentration of approximately 0.1 to 0.5 g/L. In some embodiments the nonionic surfactant is present at a working concentration of 0.2 g/L.

The anionic surfactant may also be any anionic surfactant which is compatible in photographic processing solutions. It is preferred that the anionic surfactant used reduces the surface tension of the final rinse to 33 dyne/cm or less so that, when combined with the nonionic surfactant, the lower surface tension of the rinsing solution is more easily achieved. Preferably the anionic surfactant is a sulfate or sulfonate surfactant.

In one preferred embodiment the anionic sulfate or sulfonate surfactants have the general formula $R_2$-(A)-C, wherein $R_2$ is an alkyl group with 8–20 carbons and more preferably 10–16 carbons, A is an aryl or a hydroxy ethylene group, and C is $SO_3^-M^+$or $SO_4^-M^+$wherein $M^+$is ammonium or an alkali metal such as $K^+$, $Na^+$, $Li^+$. Most preferably the anionic surfactant is sodium dodecylbenzenesulfonate (trade name "Siponate DS-10", available from Rhone-Poulenc,).

In another preferred embodiment the anionic sulfate or sulfonate surfactants have the general formula $(R_3)_n$-$(B)_x$-$(E)_y$-C, wherein $R_3$ is an alkyl group with 4–20 carbons and more preferably 4–16 carbons, n is 1 when x is 0, and n is 1, 2, or 3 when x is 1, B is a phenyl group and x is 0 or 1, E is —$(OCH_2CH_2)$—and y is an integer from 1 to 8, and C is $SO_3^-M^+$or $SO_4^-M^+$wherein $M^+$is ammonium or an alkali metal such as $K^+$, $Na^+$, and $Li^+$. Most preferably the anionic sulfate or sulfonate surfactant is sodium tributylphenoxypolyethoxysulfate (trade name Hostapal BV, available from Hoechst Celanese), or sodium alkyl($C_{12}$–$C_{15}$)polyethoxy(5) sulfate (trade name Witcolate SE-5, available from Witco).

In preferred embodiments the anionic sulfate or sulfonate surfactant is present at a working concentration of approximately 0.05 to 1.0 g/L. More preferably, the anionic surfactant is present at a working concentration of approximately 0.1 to 0.5 Most preferably, the anionic surfactant is present at a working concentration of 0.2 g/L.

In addition to the combination of surfactants described above the rinsing solution may also contain antimicrobials such as isothiazolones, halogenated phenolic compounds, disulfide compounds, and sulfamine agents. It may also contain chelating agents such as hydrolyzed polymaleic anhydride polymers,inorganic phosphoric acids, aminopolycarboxylic acids, and organic phosphoric acids. The pH is generally 5.0 to 9.0.

The photographic element is contacted with the final rinse for a sufficient amount of time to thoroughly wet it. Generally this is done by immersing the element in a tank containing the final rinse solution. It is transported by various means depending on the type of processing machine used.

The rinsing solution is used as a final rinse after the other processing steps of development, bleaching and fixing have been completed. Of course other optional and auxiliary processing steps such as stop baths and washes may be utilized with this invention. It may be used with a variety of wet processing methods known in the art, for example those described in Section XIX of *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

Any developer which is suitable for use with color silver halide photographic elements may be utilized with this invention. Such color developing solutions typically contain a primary aromatic amino color developing agent. These color developing agents are well known and widely used in a variety of color photographic processes. They include aminophenols and p-phenylenediamines. The content of the color developing agent is generally 1 to 30 grams per liter of the color developing solution, with 2 to 20 grams being more preferred and 3 to 10 grams being most preferred.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene. Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediaminemonohydrochloride, 4-N,N-diethyl-2-methylphenylenediaminemonohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, and 4-N, N-diethyl-2, 2'-methanesulfonylaminoethylphenylenediamine hydrochloride.

In addition to the primary aromatic amino color developing agent, the color developing solutions used with this invention may contain a variety of other agents such as alkalies to control pH, bromides, iodides, benzyl alcohol, anti-oxidants, anti-foggants, solubilizing agents, brightening agents, and so forth.

The photographic color developing compositions may be employed in the form of aqueous alkaline working solutions having a pH of above 7 and more preferably in the range of from about 9 to about 13. To provide the necessary pH, they may contain one or more of the well known and widely used pH buffering agents, such as the alkali metal carbonates or phosphates. Potassium carbonate is especially preferred.

Desilvering can be performed by one of the following methods (i) a method using a bleaching solution bath and fixing solution bath; (ii) a method using a bleaching solution bath and a blixing solution bath; (iii) a method using a blixing solution and a fixing solution bath; and (iv) a method using a single blixing bath. Blixing may be preferred in order to shorten the process time.

Examples of bleaching agents which may be used in the bleach solutions or blix solutions of the current invention are ferric salts, persulfates, dichromates, bromates, ferricyanides, and salts of aminopolycaroxylic acid ferric complexes, with salts of aminopolycaroxylic acid ferric complexes being preferred.

Preferred aminopolycarboxylic acid ferric complexes are listed below:

(1) ethylenediaminetetraacetic acid ferric complex;

(2) diethylenetriaminepentaacetic acid ferric complex;

(3) cyclohexanediaminetetraacetic acid ferric complex;

(4) iminodiacetic acid ferric complex;

(5) methyliminodiacetic acid ferric complex;

(6) 1,3-diaminopropanetetraacetic acid ferric complex;

(7) glycoletherdiaminetetraacetic acid ferric complex;

(8) beta-alanine diacetic acid ferric complex.

These aminopolycarboxylic acid ferric complexes are used in the form of a sodium salt, potassium salt, or ammonium salt. An ammonium salt may be preferred for speed, with alkali salts being preferred for environmental reasons.

The content of the salt of an aminopolycarboxylic acid ferric complex in the bleaching solutions and blixing solutions of this invention is about 0.05 to 1 mol/liter. The pH range of the bleaching solution is 2.5 to 7, and preferably 4.0to 7.

The bleaching solution or the blixing solution can contain rehalogenating agents such as bromides (e.g., potassium bromide, sodium bromide, and ammonium bromide), chlorides (e.g., potassium chloride, sodium chloride, and ammonium chloride), and iodides (e.g., ammonium iodide).

They may also contain one or more inorganic and organic acids or alkali metal or ammonium salts thereof, and, have a pH buffer such as boric acid, borax, sodium metaborate, acetic acid, sodium acetate, sodium carbonate, potassium carbonate, phosphorous acid, phosphoric acid, sodium phosphate, citric acid, sodium citrate, and tartaric acid, or corrosion inhibitors such as ammonium nitrate and guanidine.

Examples of fixing agents which may be used in the this invention are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); and a thiourea. These fixing agents can be used singly or in a combination of at least two agents. Thiosulfate is preferably used in the present invention.

The content of the fixing agent per liter is preferably about 0.2 to 2 mol. The pH range of the blixing or fixing solution is preferably 3 to 10 and more preferably 5 to 9. In order to adjust the pH of the fixing solution, hydrochloric acid, sulfuric acid, nitric acid, acetic acid, bicarbonate, sodium, ammonium, or potassium hydroxide, sodium carbonate, or potassium carbonate, for example, may be added.

The blixing and the fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite, acid adduct, or a carbonyl compound may also be used as a preservative.

The photographic elements of this invention can be single color or multicolor photographic elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like.

The silver halide emulsions employed in the elements of this invention can be either negative working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image. Processing to form a visible dye image includes the step of contacting the exposed element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

The following examples are intended to illustrate, without limiting, this invention.

EXAMPLES

Example 1

EKTACHROME film in 35 mm format was processed in a REFREMA Rack-and-Tank film processor (model REFREMA JUNIOR) utilizing Kodak Process E-6, as generally described in the British Journal of Photography Annal, p. 191 (1988), with the final rinse noted below being used in place of the stabilizer. The type of processing machine used for this test is also known in the trade as a "dip-and-dunk" or "hanger" type processor. Lengths of film nominally 5 foot in length were looped over racks that are automatically transported through the processing machine. A weighted double clip held the two film ends. The Final Rinse temperature was maintained between 70° F. and 80° F. The film was mechanically transported into a drying chamber maintained between 115° F. and 125° F. The test was repeated with a variety of final rinse formulas. A total of 12 pieces of film were processed at each condition.

The processed film was evaluated both for drying marks on the emulsion and for salt deposits on the base. The drying marks are characterized by a distortion of the emulsion surface in a circular, oblong or irregular curved shape originating next to the film perforations. Drying marks are readily seen by reflected light. The marks can also be seen by transmitted light and upon projection if the marks are located in low density areas of the picture area. The salt deposits on the base of the film are generally characterized by a clear to white colored line or lines that run along the length of the film. The deposits are generally referred to as "lines". The deposits have been found to contain minerals that normally contribute to water hardness, included calcium carbonate and sodium chloride. The lines are evaluated using reflected light and can usually not be seen with transmitted light or upon projection.

Each length of film was evaluated and given a rating for both drying marks and for deposits. The criteria for the ratings are listed below.

Rating scale for differential drying marks:

0 No drying marks.

1 Few drying marks and/or not easily seen (not objectionable).

2 Many well defined drying marks that are readily seen upon examination but are not in the picture area.

3 Many or well defined drying marks that extend into the picture area.

Rating scale for salt deposits on film:

(Note: Practical experience has shown salt deposits occur in the picture area of processed films. Therefore, the rating of 2 will seldom be used.)

0 No deposits.

1 Minor deposits.

2 Significant deposits that are objectionable but are not in the picture area.

3 Significant deposits that are objectionable and are in the picture area.

The following final rinse formulas were evaluated as described above. In Formula A through G, rinse solutions were mixed using nondistilled tap water.

Formula A: Proxel (antimicrobial) (60 ppm) Renex 30 (nonionic surfactant)(0.14 g/L)

Formula B: Silwet L7607 (nonionic surfactant) (0.2 g/L)

Formula C: Silwet L7607 (nonionic surfactant) (0.2 g/L) Siponate DS-10 (anionic surfactant) (0.2 g/L)

Formula D: Siponate DS-10 (anionic surfactant) (0.2 g/L)

Formula E: Triton X-102 (nonionic surfactant) (0.2 g/L) Siponate DS-10 (anionic surfactant) (0.2 g/L)

Formula F: Triton X-102 (nonionic surfactant) (0.2 g/L)

Formula G: Silwet L7607 (nonionic surfactant) (0.2 g/L) added to Formula A

The results are shown in Table I.

TABLE I

EVALUATION OF PROCESSED FILM FOR DRYING MARKS AND DEPOSITS
(Data below is percent of film within each category)

| FORMULA | 0 | 1 | 2 | 3 |
|---|---|---|---|---|
| | RATINGS FOR DRYING MARKS | | | |
| A | 0 | 0 | 0 | 100 |
| B | 100 | 0 | 0 | 0 |
| C | 100 | 0 | 0 | 0 |
| D | 100 | 0 | 0 | 0 |
| E | 100 | 0 | 0 | 0 |
| F | 0 | 0 | 0 | 100 |
| G | 100 | 0 | 0 | 0 |
| | RATINGS FOR DEPOSITS | | | |
| A | 17 | 33 | 0 | 50 |
| B | 17 | 33 | 0 | 50 |
| C | 58 | 25 | 0 | 17 |
| D | 8 | 42 | 0 | 50 |
| E | 58 | 25 | 0 | 17 |
| F | NOT RATED FOR DEPOSITS | | | |
| G | 0 | 8 | 0 | 92 |

SURFACE TENSION OF SOLUTION

| FORMULA | SURFACE TENSION (Dynes/cm) |
|---|---|
| A | 31 |
| B | 24 |
| C | 25 |
| D | 26 |
| E | 27 |
| F | 32 |
| G | 25 |

Example 2

A quantity of 35 mm EKTACHROME film was processed on a COLENTA roller transport machine in order to generate film free from drying marks. The process used in the COLENTA machine was as described in Example 1. The film was cut into nominal 16 inch lengths. The individual strips were subsequently rewet in 100° F. water for 10 minutes and used to evaluate a variety of final rinse formulas.

The film strips were hung on a clip and a weight was attached to the opposite end. Each film strip was immersed for 2 minutes into one of the various final rinse formulas tested. The final rinse was maintained at room temperature. The film was carefully removed from the final rinse solution so that the thin liquid droplets of final rinse solution were retained in the perforations. The film was then observed as it dried at room temperature.

The film was evaluated in a variety of final rinse formulas for its potential to form drying marks by measuring the time it took for the liquid droplets in the perforation to burst. The shorter the time, the less chance of drying marks being produced. Two times were recorded for each variation. The first was the elapsed time from the film being removed from the final rinse until the first droplets were noted to burst. The second time was the elapsed time until the majority of the droplets in the perforation had burst.

Each piece of dry film was evaluated for drying marks.

26 final rinse formulas were investigated. In each case a nonionic surfactant (at 0.2 g/L of active ingredient) was tested both individually and in combination with one or more anionic surfactants (also at 0.2 g/L). Table II lists the solutions tested and experimental results. The column labeled "start" is the elapsed time from when the film was removed from the final rinse solution until the first droplets in the perforations were observed to burst. The column labeled "end" is the elapsed time until most or all of the droplets had burst. In most cases the time has been rounded to the nearest 30 second increment. The column labeled "drying marks" indicates whether or not the dried film exhibited drying marks. The surface tension of each solution was also measured and tabulated.

TABLE II

| SURFACTANT(S) | START (MIN) | END (MIN) | SURFACE TENSION (Dynes/cm) | DRYING MARKS |
|---|---|---|---|---|
| TRITON X-100 | 1.5 | 2.0 | 29 | no |
| TRITON X-100 + SIPONATE DS-10 | 0.0 | 0.5 | 27 | no |
| TRITON X-102 | 2.5 | 3.0 | 32 | yes |
| TRITON X-102 + SIPONATE DS-10 | 0.0 | 0.5 | 28 | no |
| SURFACTANT 10G | 2.0 | 2.5 | 31 | yes |
| SURFACTANT 10G + SIPONATE DS-10 | 0.0 | 0.5 | 28 | no |
| NEODOL 25-7 | 1.0 | 2.5 | 29 | yes |
| NEODOL 25-7 + SIPONATE DS-10 | 0.5 | 1.0 | 28 | no |
| PLURONIC L-44 | 1.5 | 2.5 | 42 | yes |
| PLURONIC L-44 + SIPONATE DS-10 | 0.75 | 1.0 | 28 | no |
| SILWET L-7607 | 0.5 | 1.0 | 24 | no |
| SILWET L-7607 + SIPONATE DS-10 | 0.0 | 0.5 | 25 | no |
| ZONYL FSN | 1.0 | 2.0 | 28 | no |
| ZONYL FSN + SIPONATE DS-10 | 0.5 | 1.0 | 23 | no |
| TRITON X-102 | 2.5 | 3.0 | 32 | yes |
| TRITON X-102 + WITCOLATE AOS | 1.0 | 2.0 | 30 | some |
| TRITON X-102 WITCOLATE 1075X | 1.0 | 2.0 | 32 | some |
| TRITON X-102 + ALIPAL CO-436 | 1.0 | 2.5 | 29 | some |
| TRITON X-405 | 2.0 | 3.0 | 42 | yes |
| TRITON X-405 + SIPONATE DS-10 | 1.0 | 1.5 | 30 | no |
| TRITON X-102 + HOSTAPAL BV | 1.0 | 3.0 | 30 | some |
| TRITON X102 WITCOLATE SE-5 | 1.0 | 3.0 | 32 | some |
| RENEX 30 | 1.0 | 2.0 | 31 | yes |
| RENEX 30 + SIPONATE DS-10 | 0.0 | 0.5 | 26 | no |

Example 3

EKTACHROME film in 35 mm format was hand processed in a Sink-Line process through the final wash. The Sink-Line used for this processing consisted of 5 gallon tanks contained in a constant temperature bath. The temperature of the bath was controlled to 100° F. with an electric heater and circulation pump. The wash steps were performed in a separate tank with continuous fresh flowing water maintained between 85 and 100° F. The procedures and processing chemistry were as described in Example 1.

The film was loaded on NIKOR reels for processing and manually transported through the tanks in the Sink-Line. The film was processed in the Sink-Line through all processing steps except for the final rinse. The NIKOR reels were removed from the Sink-Line after the final wash step. The film was removed from the NIKOR reel and hung on a clip. A weight was attached to the other end of the film. Each film was dipped in one of the various final rinse formulas tested. The film was immersed for 45 to 75 seconds in a final rinse formula contained in a standard laboratory graduated cylinder kept at room temperature. The film was carefully removed from the cylinder and hung to dry at room temperature.

The film was evaluated as described in EXAMPLE 2. In this experiment, anionic surfactants were tested individually and in combination with SILWET L-7607 (a nonionic surfactant). SILWET L-7607 was also tested alone. In all cases the surfactants were mixed at concentrations of 0.2 g/L in tap water.

The test was evaluated as described in EXAMPLE 2. The results are listed in Table III.

TABLE III

| SURFACTANT(S) | START (MIN) | END (MIN) | SURFACE TENSION (Dynes/cm) | DRYING MARKS |
|---|---|---|---|---|
| WITCOLATE SE-5 (anionic) | 1.0 | 2.5 | 30 | SOME |
| WITCOLATE SE-5 (anionic) SILWET L-7607 (nonionic) | 0.0 | 0.5 | 28 | NO |
| KLEARFAC AA-270 (anionic) | 2.0 | 3.0 | 38 | YES |
| KLEARFAC AA-270 (anionic) + SILWET L-7607 (nonionic) | 0.5 | 2.0 | 25 | NO |
| SILWET L-7607 (nonionic) | 0.25 | 1.0 | 24 | NO |

Example 4

A variety of final rinse formulas were evaluated as described in EXAMPLE 2. In this experiment, anionic and nonionic surfactants were tested individually. In each case the surfactant was mixed at a concentration of 0.2 g/L in tap water.

The tests were evaluated as described in Table IV. The first 6 surfactants listed in the table resulted in reduction or elimination of drying marks. The remaining 10 surfactants did not reduce drying marks.

TABLE IV

| SURFACTANT(S) | START (MIN) | END (MIN) | SURFACE TENSION (Dynes/cm) | DRYING MARKS |
|---|---|---|---|---|
| ZONYL FSN (nonionic) | 1.0 | 2.0 | 28 | no |
| SILWET L-7607 (nonionic) | 0.5 | 1.0 | 24 | no |
| SIPONATE DS-10 (anionic) | 0.0 | 1.0 | 26 | no |
| TRITON X-100 (nonionic) | 1.5 | 2.0 | 29 | no |
| WITCOLATE 1075X (anionic) | 1.0 | 2.0 | 28 | some |
| WITCOLATE AOS (anionic) | 1.0 | 2.0 | 26 | some |
| TRITON X-102 (nonionic) | 2.5 | 3.0 | 32 | yes |

TABLE IV-continued

| SURFACTANT(S) | START (MIN) | END (MIN) | SURFACE TENSION (Dynes/cm) | DRYING MARKS |
|---|---|---|---|---|
| TRITON X-405 (nonionic) | 2.0 | 3.0 | 42 | yes |
| NEODOL 25-7 (nonionic) | 1.5 | 2.0 | 29 | yes |
| PLURONIC L-44 (nonionic) | 1.5 | 2.5 | 42 | yes |
| SURFACTANT 10G (nonionic) | 2.0 | 2.5 | 31 | yes |
| HOSTAPAL BV (anionic) | 2.0 | 3.0 | 29 | yes |
| AVANEL S-70 (anionic) | 2.0 | 3.0 | 32 | yes |
| WITCOLATE SE-5 (anionic) | 2.0 | 3.0 | 30 | yes |
| WITCOLATE D51-52 (anionic) | 2.0 | 3.0 | 30 | yes |
| FLUORAD FC-99 (anionic) | 3.0 | 5.0 | 56 | yes |

Example 5

Two final rinse formulas containing a nonionic surfactant and an anionic surfactant were evaluated in 4 rack-and-tank processing machines. In each case a base line was established by processing a minimum of 20 rolls of 35 mm EKTACHROME film over a period of two weeks while the machines were using the process described in Example 1, using Formula A as the final rinse. The final rinse in all four machines was then drained and replaced with the following formula mixed using nondistilled water:

| Formula I | |
|---|---|
| TRITON X-102 (nonionic surfactant) | 0.2 g/L |
| SIPONATE DS-10 (anionic surfactant) | 0.2 g/L |
| KATHON LX microbicide | 0.01 g/L |

In the E-6-150 machine, after the evaluation of Formula I, Formula I was drained out and replaced with Formula II which was mixed with non-distilled tap water.

| Formula II | |
|---|---|
| RENEX 30 (nonionic surfactant) | 0.14 g/L |
| SIPONATE DS-10 (anionic surfactant) | 0.20 g/L |
| KATHON LX microbicide | 0.01 g/L |

The processing machines were:

| Machine | Manufacturer | Model |
|---|---|---|
| DDP40 | HOSTERT | DDP40/120 |
| E6-150 | REFREMA | E6-150-GL/VESS |
| E6-80 | REFREMA | E6-80-GL/VESS |
| E6-100 | REFREMA | E6-100-GL/VESS |

Each machine was again evaluated by processing a minimum of 30 rolls of 35 mm film over a two week period. The processed film was evaluated for both drying marks and for salt deposits as described in EXAMPLE 1.

Table V lists the percent of film that had no noticeable drying marks or no noticeable deposits. With the one exception noted on the chart, all of the drying marks and the deposits were judged to be no greater that level 1. In the column labeled "final rinse", an entry of "comparison" indicates that the process of Example 1, using Formula A was used. An entry of "invention" indicates that the formula described above was used.

TABLE V

EVALUATION OF PROCESSED FILM FOR DRYING MARKS AND DEPOSITS
(Data is the percent of film with no drying marks or deposits)

| PROCESSING MACHINE | FINAL RINSE | DRYING MARKS | DEPOSITS |
|---|---|---|---|
| E6-150 | Comparison | 25% | 20% |
| E6-150 | Invention (Formula I) | 66% | 59% |
| | Invention (Formula II) | 95% | 58% |
| DDP40 | Comparison | 75% | 65% |
| DDP40 | Invention (Formula I) | 74% | 74% |
| E6-80 | Comparison | 95% | 0%(*) |
| E6-80 | Invention (Formula I) | 90% | 10%(*) |
| E6-100 | Comparison | 15% | 20% |
| E6-100 | Invention (Formula I) | 47% | 30% |

(*)On the E6-80 machine a few of the mineral deposits were rated as level three. With the comparative final rinse, 20 percent were level 3. With the invention, 3 percent were level 3.

The invention has been described in detail with particular reference to preferred embodiments thereof, but it will be understood that variations and modifications can be effected within the spirit and scope of the invention.

What is claimed is:

1. A method of processing a silver halide photographic element comprising, after development, bleaching and fixing, rinsing the photographic element a final time with a rinsing solution consisting essentially of a working concentration of from about 0.05 to about 0.6 g/1 of a nonionic surfactant and a working concentration of from about 0.05 to about 1 g/1 of an anionic surfactant, wherein said solution has a surface tension of 32 dynes/cm or less, and wherein said solution is free of a dye stabilizing compound, said anionic surfactant having either:

(a) the chemical formula $R_2$-(A)-C, wherein $R_2$ is an alkyl group having 8 to 20 carbon atoms, A is a phenyl group or a hydroxy ethylene group, and C is $SO_3^-M^+$, wherein $M^+$is $NH_4^+$, $Na^+$, $K^+$, or $Li^+$, or (b) the chemical formula $(R_3)_n$-$(B)_x$-$(E)_y$-C, wherein $R_3$ is an alkyl group having 4 to 20 carbon atoms and n is 1 when x is 0, and n is 1, 2 or 3 when x is 1, B is a phenyl group and x is 0 or 1, E is a —$(CH_2CH_2)$—group and y is an integer from 1 to 8, and C is $SO_3^-M^+$or $SO_4^-M^+$, wherein said $M^+$is ammonium, sodium, potassium or lithium ion; and said nonionic surfactant is a nonionic hydrocarbon polyethoxylated surfactant having the chemical formula $R_1$-$(B)_x$-$(E)_m$-D, wherein $R_1$ is an alkyl group having 8 to 20 carbon atoms, B is a phenyl group, x is 0 or 1, E is a —$(OCH_2CH_2)$—, m is an integer from 6 to 20, and D is —OH or —$OCH_3$.

2. The method of claim 1 wherein the solution has a surface tension of 30 dynes/cm or less.

3. The method of claim 1 wherein the solution has a surface tension of 28 dynes/cm or less.

4. The method of claim 1 wherein the anionic surfactant is sodium dodecylbenzenesulfonate.

5. The method of claim 4 wherein the nonionic surfactant is octylphenoxypolyethyleneoxide (12) ethanol, polyalkyleneoxide modified poly (dimethylsiloxane) or tridecylpolyethyleneoxide (12) alcohol.

6. The method of claim 1 wherein $R_2$ contains 10 to 16 carbon atoms.

7. The method of claim 1 wherein said anionic surfactant has the chemical formula $(R_3)_n$-$(B)_x$-$(E)_y$-C, wherein $R_3$ is an alkyl group having 4 to 20 carbon atoms and n is 1 when x is 0, and n is 1, 2 or 3 when x is 1, B is a phenyl group and x is 0 or 1, E is a —$(CH_2CH_2)$—group and y is an integer from 1 to 8, and C is $SO_3^-M^+$or $SO_4^-M^+$, wherein said $M^+$is ammonium, sodium, potassium or lithium ion.

8. The method of claim 1 wherein $R_3$ contains 4 to 16 carbon atoms.

9. The method of claim 1 wherein each of said anionic and nonionic surfactants is present, independently, in said rinsing solution at a working concentration of from about 0.1 to about 0.5 g/1.

10. The method of claim 1 wherein said nonionic surfactant is tridecylpolyethyleneoxide (12) alcohol and said anionic surfactant is sodium dodecylbenzenesulfonate, and wherein the surface tension of said solution is 28 dynes/cm or less.

11. The method of claim 1 wherein said nonionic surfactant is octylphenoxypolyethyleneoxide (12) ethanol and said anionic surfactant is sodium dodecylbenzenesulfonate, and wherein the surface tension of said solution is 28 dynes/cm or less.

12. A method of processing a silver halide photographic element comprising, after development, bleaching and fixing, rinsing the photographic element a final time with a rinsing solution consisting essentially of a working strength concentration of from about 0.1 to about 0.5 g/1 of a nonionic surfactant and a working strength concentration of from about 0.1 to about 0.5 g/1 of an anionic surfactant, wherein said solution has a surface tension of 32 dynes/cm or less and is free of a dye stabilizing compound, said anionic surfactant having either:

(a) the chemical formula $R_2$-(A)-C, wherein $R_2$ is an alkyl group having 8 to 20 carbon atoms, A is a phenyl group or a hydroxy ethylene group, and C is $SO_3^-M^+$, wherein $M^+$is $NH_4$+, $Na^+$, $K^+$, or $Li^+$, or (b) the chemical formula $(R_3)_n$-$(B)_x$-$(E)_y$-C, wherein $R_3$ is an alkyl group having 4 to 20 carbon atoms and n is 1 when x is 0, and n is 1, 2 or 3 when x is 1, B is a phenyl group and x is 0 or 1, E is a —$(CH_2CH_2)$—group and y is an integer from 1 to 8, and C is $SO_3^-M^+$or $SO_4^-M^+$, wherein said $M^+$is ammonium, sodium, potassium or lithium ion; and said nonionic surfactant is a nonionic hydrocarbon polyethoxylated surfactant having the chemical formula $R_1$-$(B)_x$-$(E)_m$-D, wherein $R_1$ is an alkyl group having 8 to 20 carbon atoms, B is a phenyl group, x is 0 or 1, E is a —$(OCH_2CH_2)$—, m is an integer from 6 to 20, and D is —OH or —$OCH_3$.

13. A method of processing a silver halide photographic element comprising rinsing the photographic element with a rinsing solution consisting essentially of from about 0.05 to about 0.6 g/1 of either octylphenoxypolyethyleneoxide (12) ethanol or tridecylpolyethyleneoxide (12) alcohol nonionic surfactant, and from about 0.05 to about 1 g/1 of sodium dodecylbenzenesulfonate anionic surfactant, wherein the surface tension of said rinsing solution is 28 dynes/cm or less, and wherein said solution is free of a dye stabilizing compound.

* * * * *